US006835123B2

(12) United States Patent
Shiga et al.

(10) Patent No.: US 6,835,123 B2
(45) Date of Patent: Dec. 28, 2004

(54) CENTRIFUGAL PROJECTING MACHINE

(75) Inventors: Masaji Shiga, Aichi-ken (JP); Masahiro Kitagawa, Aichi-ken (JP)

(73) Assignee: Sintokogio, Ltd., Nagoya (JP)

( * ) Notice: Subject to any disclaimer, the term of this patent is extended or adjusted under 35 U.S.C. 154(b) by 277 days.

(21) Appl. No.: 10/069,458

(22) PCT Filed: Jun. 25, 2001

(86) PCT No.: PCT/JP01/05405

§ 371 (c)(1),
(2), (4) Date: Feb. 26, 2002

(87) PCT Pub. No.: WO02/00393

PCT Pub. Date: Jan. 3, 2002

(65) Prior Publication Data

US 2002/0112515 A1 Aug. 22, 2002

(30) Foreign Application Priority Data

Jun. 26, 2000 (JP) ..... 2000-191777

(51) Int. Cl.[7] ..... B24C 5/06; B24C 9/00
(52) U.S. Cl. ..... 451/94; 451/95; 72/53
(58) Field of Search ..... 72/53; 451/94, 451/95

(56) References Cited

U.S. PATENT DOCUMENTS 3,319,383 A * 5/1967 Bowling, Jr. et al. ..... 451/94
3,368,308 A * 2/1968 Physioc, III ..... 451/95
3,744,190 A * 7/1973 DeGrot et al. ..... 451/94
4,291,509 A * 9/1981 Schulte et al. ..... 451/95
4,336,672 A * 6/1982 Kwolek ..... 451/95
5,076,028 A * 12/1991 McDade ..... 451/95
5,888,125 A * 3/1999 Kuehn ..... 451/95

FOREIGN PATENT DOCUMENTS

| | | | |
|---|---|---|---|
| DE | 2437493 | * | 2/1976 |
| JP | 49-27792-12 | * | 3/1973 |
| JP | 56-57756 | * | 5/1981 |
| JP | 2506549 | | 5/1996 |

* cited by examiner

*Primary Examiner*—David Jones
(74) *Attorney, Agent, or Firm*—Finnegan, Henderson, Farabow, Garrett & Dunner, L.L.P.

(57) ABSTRACT

A centrifugally projecting apparatus is provided to allow a liner to be easily exchanged, to prevent projecting members from projecting through the connected parts of the liner components, and to prevent an impeller cover from being abraded. The apparatus comprises bolts 36, 36*a* and a fixing member (hook members 24, 24) to press first and second-side liner components 31, 31A, front and rear-side liner components 34, 34A, and a frame-liner component 37 against a ceiling-side liner component 39 so that they are fixed to each other.

5 Claims, 4 Drawing Sheets

CENTRIFUGAL PROJECTING MACHINE

FIELD OF INVENTION

The present invention relates to a centrifugal apparatus for projecting shots for a shot blast machine. Particularly, it relates to a mechanism to prevent a cover for an impeller from being abraded.

BACKGROUND OF THE INVENTION

Conventionally, liners are put on the inner side of a cover for an impellers so that they surround the impeller of a centrifugal apparatus for projecting shots for a shot blast machine to prevent the cover from being abraded. Also, the liners are divided into pieces and used for front and rear sides, right and left sides, and an upper side. These sides are named based on the direction that the impeller rotates. The pieces are also divided into small pieces. Thus there is a problem in that there are too many pieces. Japanese Utility Model No. 2506549 discloses an improvement of the liners that are located at the front and rear sides. The liners are formed as U-shaped rain gutters as viewed from their cross-sections, so that the number of pieces may be decreased.

When any piece of the liners is abraded, a new one replaces it. The pieces of liners are engaged by screws to the cover for an impeller. When they are replaced, those screws must be unscrewed to remove the pieces from the cover. Then, new ones replace those pieces. These replacements are troublesome.

Because the pieces of the liners are screwed to the cover, the pieces tend not to closely contact the cover. Thus, those connections are easily abraded by shots. Thus, projecting members (shots) are projected out of the connections. Thus, the cover is also abraded.

This invention has been conceived to overcome the problems referred to above. The object of this invention is to provide a centrifugal apparatus for projecting shots wherein liners that have been abraded can be easily replaced by new ones, and wherein shots are prevented from being projected through the connection between the pieces and the cover, so that the cover can be definitely prevented from being abraded.

SUMMARY OF THE INVENTION

Thus, the object is achieved by the centrifugal apparatus for projecting shots of this invention. The apparatus comprises an impeller, a cover for the impeller surrounding it, and a liner that is located within the cover. The cover is comprised of first and second-side cover components located at right and left sides, front and rear cover components, and a ceiling cover component that can be opened and closed. The liner can be screwed to the cover, so that it can be disengaged from it. The liner is comprised of first- and second-side liner components each having an opening through which the rotating shaft of the impeller can pass, front- and rear-side liner components that are U-shaped and that are pressed against the ends of the first- and second-side liner components and fixed on them, and liner components that are pressed against the upper ends of the first- and second-side liner components and the front- and rear-side liner components and fixed on them.

Another concept of the centrifugal apparatus for projecting shots of this invention includes an impeller in which a hub, impeller-side plates, impeller blades, and a distributor are rotatably located on a rotating shaft, an impeller cover surrounding the impeller, and a liner. The impeller cover is comprised of first and second cover components located at right and left sides, front and rear cover components, and a ceiling cover component that can be opened and closed. The liner components can be screwed to the impeller cover, so that it can be disengaged from it.

The liner components are comprised of first- and second-side liner components having openings through which the rotating shaft of the impeller can pass, front and rear side liner components that are U-shaped and that are pressed against the ends of the first and second-side liner components and fixed on them, a frame-liner component that is engaged with the upper ends of the first- and second-side liner components and the front- and rear-side liner components, and a ceiling-side liner component that can be engaged with and disengaged from the frame-liner component. A labyrinthine structure is located at the connecting surfaces between the ceiling-side liner component and the first- and second-side liner components. The labyrinthine structure has four portions bent along the direction of the projection of the projecting members. The ceiling-side liner can be pressed against the impeller cover by a fixing member located on the impeller cover, and fixed on it.

A further concept of the centrifugal apparatus for projecting shots of this invention includes a protecting member for an impeller cover. The protecting member includes the impeller cover surrounding the front, rear, left, right, and ceiling sides of an impeller, first- and second-side liner components to protect the left and right sides of the impeller cover, front- and rear-side liner components to protect the front and rear sides of the impeller cover, a ceiling-side liner component to protect the ceiling side of the impeller cover, and a frame-liner component. The impeller cover comprises first- and second-side cover components having openings at the left and right sides, plate-like front and rear-side cover components at the front and rear sides, and a ceiling-side cover component that can be opened and closed at the upper side. The impeller cover is generally formed as a box shaped as a trapezoid. The first- and second-side liner components are generally shaped like trapezoids and have openings at the center through which the first- and second-side plates pass. The first- and second-side liner components are fixed on the impeller cover by screws. The front and rear-side liner components are formed as rain gutters that are U-shaped and inclined. The front- and rear-side liner components are pressed against and fixed on the right- and left ends of the first- and second-side liner components by bolts that are passed through the front and rear plates of the impeller cover. A labyrinthine structure is located at the connecting surfaces between the ceiling-side liner component and the first and second-side liner components. The labyrinthine structure comprises four portions bent in the direction of the projection of shots. The frame-liner component is shaped as a loop that comprises a vertical plate to define an opening so that the upper ends of the liner components that are engaged, pressed, and fixed within the impeller cover may pass through the opening. The frame-liner component is engaged with these upper ends. The ceiling-side liner component has a looped-projection formed along its periphery on its lower surface. The looped-projection is inserted into a U-shaped groove formed by the upper ends of the side-liner components and the vertical plates of the frame-liner component. The ceiling-side liner component is pressed down by a fixing member that is located on the impeller cover and fixed on the frame-liner component.

BRIEF DESCRIPTIONS OF THE DRAWINGS

DESCRIPTIONS OF THE PREFERRED EMBODIMENTS

Figure 1:
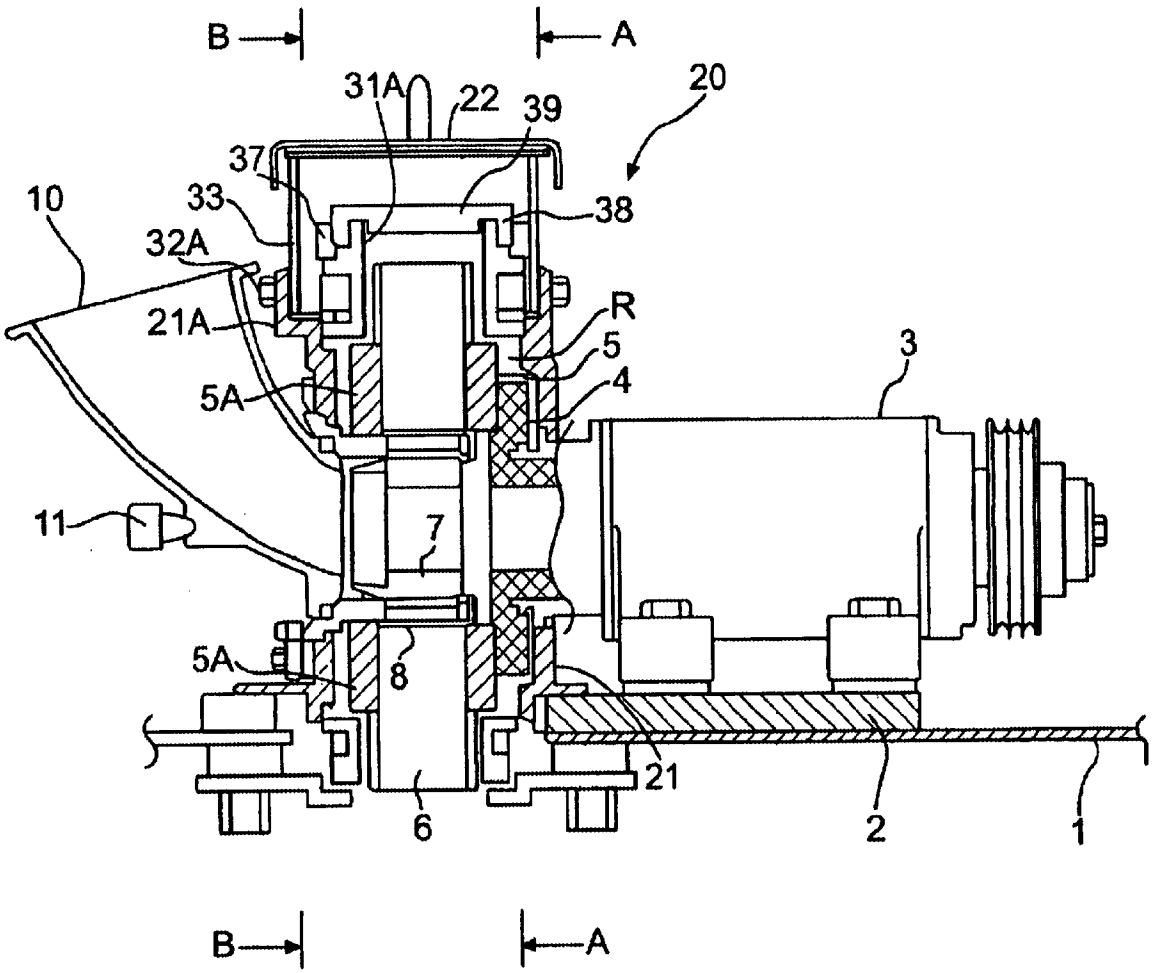
FIG. 1 is a cross-sectional and vertical view of an embodiment of the centrifugal projecting apparatus of this invention.

Based on FIGS. 1–4 an embodiment of this invention is now explained. FIG. 1 shows a centrifugal apparatus for projecting shots. It also shows a plate 1 of a cabinet that has an opening. A plate 2 has an opening. The plate 2 is located on the plate 1 such that these openings coincide with each other. A bearing 3 is fixed on the upper surface of the base 2. The bearing 3 holds a rotating shaft. An impeller R is fixed by a hub 4 to the end of the rotating shaft, and faces the openings.

Based on FIG. 1 the impeller R is now explained. A first-side impeller plate 5 is fixed on the front side of the hub 4. The first-side impeller plate 5 is connected to a second-side impeller plate 5A by a stay bolt so that spacing is formed between them. Many impeller blades 6, 6 are radially located between the first-and second-side impeller plates 5, 5A and are engaged with and fixed on them. A distributor 7 is fixed on the first-side impeller plate 5 within the bases of the impeller blades 6, 6. A control cage 8 is arranged on the outer surface of the distributor 7. The control cage is inserted into the opening of the second-side cover component 21A and fixed on it. An opening of a nozzle 10 is connected to the control cage 8. The nozzle 10 is fixed on the impeller cover 20 by a cramping member 11, as explained below.

Figure 2:
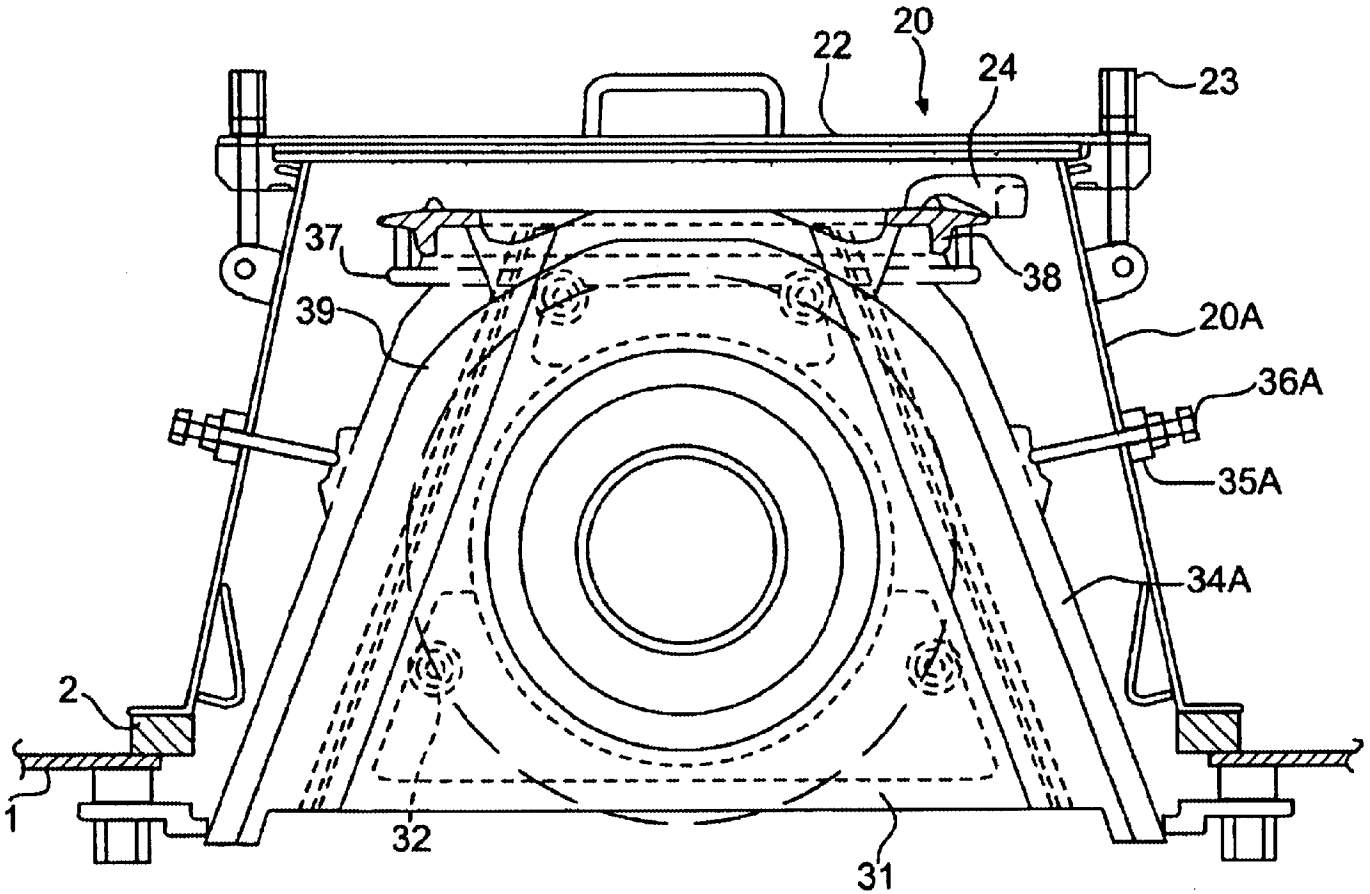
FIG. 2 is a view along the arrow A—A of FIG. 1.
Figure 3:
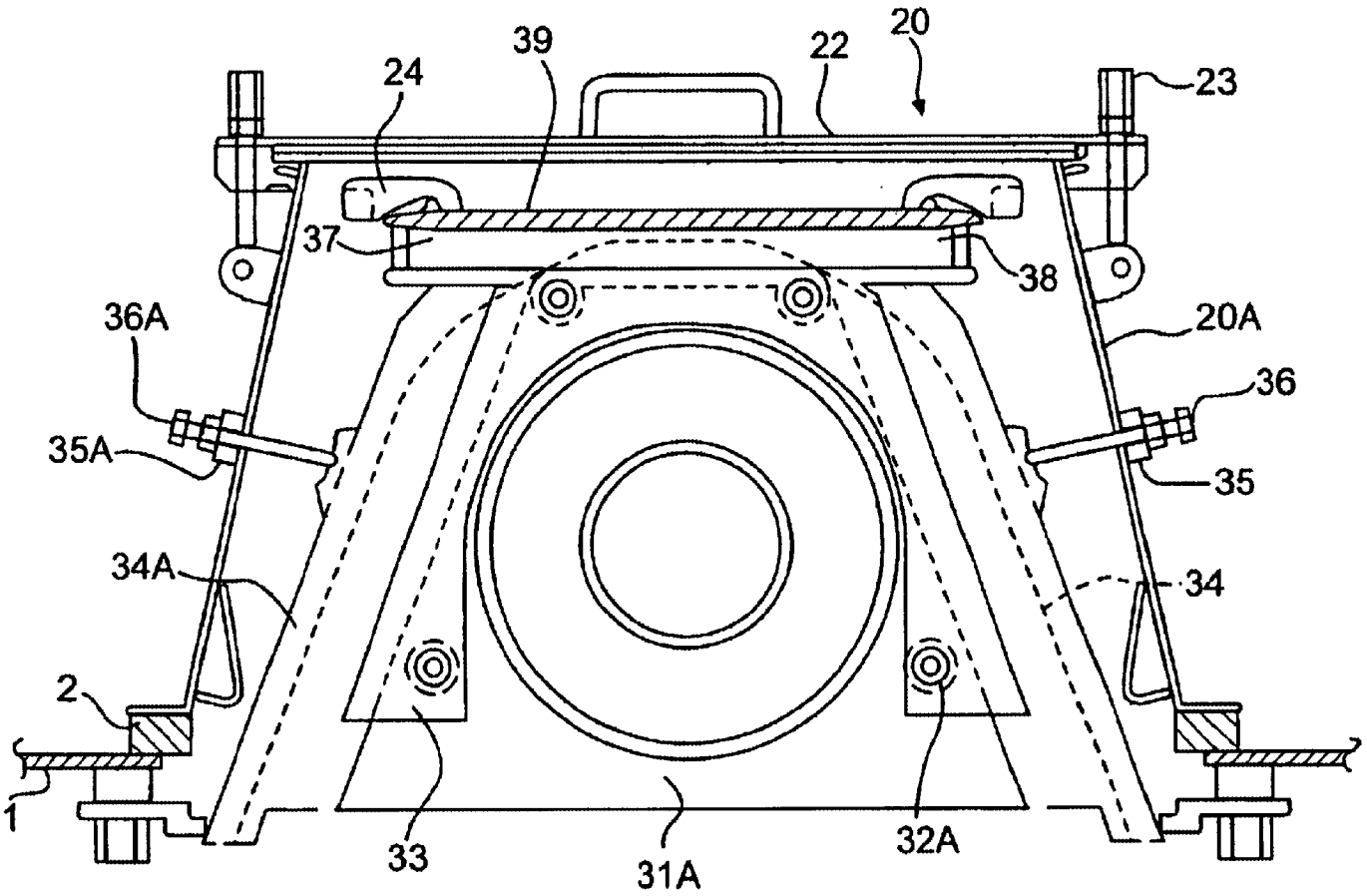
FIG. 3 is a view along the arrow B—B of FIG. 1.

Next, based on FIGS. 1, 2, and 3 the impeller cover 20 is explained. It is formed as a box shaped as a trapezoid. The bottom of it is open and arranged in line with the opening of the base 2, so that the impeller cover 20 can cover the impeller R.

The front and rear side parts of the impeller cover 20 are the front- and rear-side cover components 20A, 20A (FIGS. 2 and 3). At the right side of the impeller cover 20, the first-side cover component 21 is located (FIG. 1). The first-side cover component 21 has an opening into which the bearing 3 is inserted, so that the outer surface of the bearing is engaged with the first-side cover component 21. At the left side of the impeller cover 20, the second-side cover component 21A is located (FIG. 1). The second-side cover component 21A has an opening into which the control cage 8 is inserted, so that the outer surface of the control cage 8 is engaged with the second-side cover component 21A. The upper part of the impeller cover 20 is a ceiling cover 22. The ceiling cover 22 can be removed by means of rotating cramp-type screws 23, 23 (FIGS. 2 and 3), which are put at the front and rear positions of the impeller cover 20.

Figure 4:
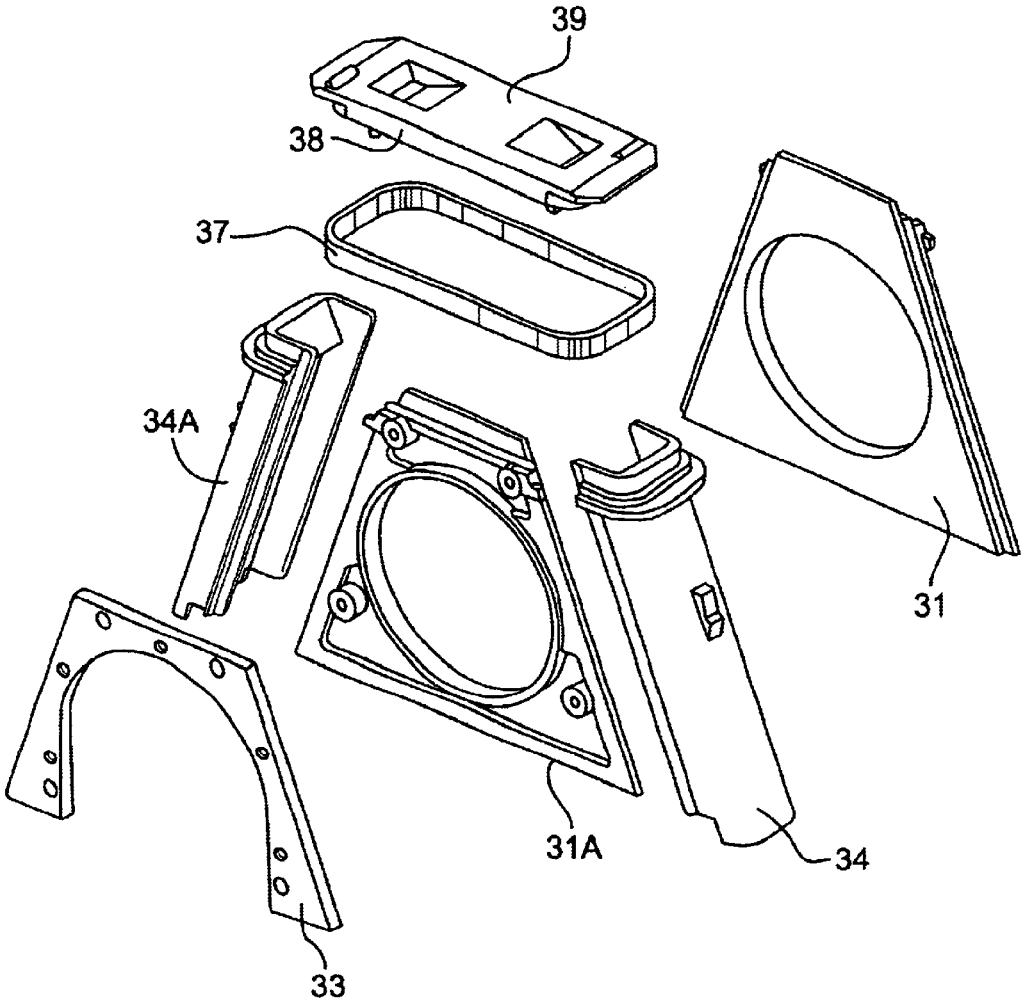
FIG. 4 is a view of a broken liner.

Based on FIG. 4, arranging and combining the side liner components are now explained. The first-side liner component 31 is screwed by screws 32, 32 and nuts that are positioned at four up-and-down positions (as in FIG. 2) on the inner surface of the first-side cover component 21 (FIG. 1). The first-side liner component 31 is shaped like a trapezoid. It has an opening at the center through which the first-and second-side impeller plates 5, 5A can pass. The second-side liner component 31A is screwed through a horseshoe-like spacer 33 by screws 32A, 32A and nuts on four up-and-down positions (as in FIG. 3) on the inner surface of the second-side cover component 21A. The horseshoe-like spacer 33 is used to adjust the distance between the second-side cover component 21A and the second-side liner component 31A. The second-side liner component 31A is shaped as a trapezoid and has an opening at the center through which the second-side impeller plate 5A can pass.

At the front and rear sides of the first- and second-side liner components 31, 31A (the left and right sides in FIGS. 2 and 3), the front- and rear-side liner components 34, 34A are located on the front- and rear-side cover components 20A, 20A of the impeller cover 20. The front- and rear-side liner components 34, 34A are U-shaped, like a rain gutter, and inclined (FIG. 4).

The front and rear-side liner components 34, 34A can be removed from the front- and rear-side cover components 20A, 20A. The front- and rear-side liner components 34, 34A are pressed against the front- and rear-side cover components 20A, 20A by means of pressing bolts 36, 36A located on brackets 35, 35A, and are fixed on them. Thus, when shots are jammed between threads of the bolts 36, 36A, those bolts are replaced by new ones or repaired after they are removed from the front- and rear-side cover components 20A, 20A.

The frame-liner component 37 engages the upper ends of the first and second-side liner components 31, 31A and the front and rear-side liner components 34, 34A. The frame-liner component 37 is shaped as a loop to form an opening through which the upper ends of the first and second-side liner components 31, 31A and the front and rear-side liner components 34, 34A pass. A ceiling-side liner component 39 is located on the frame-liner component 37. The ceiling-side liner component 39 has a looped projection 38 at its lower surface. The looped projection 38 is inserted into a looped and U-shaped groove that is defined by the upper ends of the side liner components 31, 31A, 34, 34A and the frame-liner component 37.

A labyrinthine structure is formed at the connecting part between the ceiling-side liner component 39 and the first- and second-side liner components 31, 31A. The labyrinthine structure has four bent points bent in the direction of the projection of shots.

The ceiling-side liner component 39 is pressed down by hook-like members 24, 24 (FIGS. 2 and 3). The members are located at the front and rear positions of the upper ends of the impeller cover 20. Alternatively, instead of the hook-like members 24, 24, the ceiling-side liner component 39 may be pressed by bolts that pass through the ceiling cover 22.

Next, how some of the liner components are exchanged is explained. When the ceiling-side liner component 39, which tends to be relatively easily abraded, is exchanged, the rotating cramp-type screws 23, 23 (FIGS. 2 and 3) are loosened and dislocated, and then the ceiling cover 22 is removed. Then, the hook-like members 24, 24 are rotated to extend beyond the ceiling-side liner component 39. Then, the component 39 is taken out from the opening of the impeller cover 20. A new liner component is put in place of the component 39.

When the front- and rear-side liner components 34, 34A are exchanged, first, the above operations are carried out until the ceiling-side liner component 39 is removed. Then, the frame-liner component 37 is manually taken out. Then, one of the bolts 36, 36A that screws the abraded liner component is loosened so that the abraded side liner component can be pulled up in the same direction that it is inclined. In place of the liner component a new one is put in.

When the first and second-side liner components 31, 31A, which are relatively slowly abraded, are exchanged, first, the above operations are carried out until the front- and rear-side liner components are removed. Then, the cramping member 11 is removed so that both the control gage 8 and the distributor 7 can be pulled toward the side where the nozzle 10 is located. Then, the impeller blades 6, 6 are pressed toward the central opening at the space between the impeller-side plates 5, 5A, and are pulled out toward the side where the nozzle 10 is located, as in the case of the control gage 8.

Then, the screws 32A, 32A, which screw the second-side cover component 21A, the spacer 33, which is shaped as a horseshoe, and the second-side liner component 31A, are loosened and pulled out. Then, the horseshoe-shaped spacer 33 is pulled up, and the second-side liner component 31A is slightly moved to the nozzle 10, so as to allow the second impeller-side plate 5A to pass through the opening, in relation to it, of the second-side liner component 31A. Then, the second-side liner component 31A is moved up and taken out of the upper opening of the impeller cover 20.

Then, the screws 32, 32, which screw the first-side cover component 21, and the first-side liner component 31, are loosened and pulled out. Then, the first-side liner component 31 is moved to allow the first and second impeller-side plates 5, 5A to pass through the opening, in relation to it. Then, as in the case of the second-side liner component 31A, the first-side liner component 31 is moved up to be taken out of the upper opening of the impeller cover 20. The first and second-side liner components 31, 31A are replaced by new liner components.

As in FIGS. 1, 2, and 3, the ceiling-side liner component 39 is connected to the upper ends of the side liner components 31, 31A, 34, and 34A by the pressing members (hook-like members 24, 24) pressing the ceiling-side liner component 39, so that the ceiling-side liner component 39 is fixed on the upper ends. Also, at the connecting part between the ceiling-side liner component 39 and the first- and second-side liner components 31, 31A, a labyrinthine structure that has at least four bent points bent in the direction of the projection of the shots is located, so that shots can definitely be prevented from projecting through the connecting part.

Also, the first and second-side liner components 31, 31A are connected to the front and rear-side liner components 34, 34A by pressing the front and rear-side liner components 34, 34A against the first- and second-side liner components 31, 31A using the pressing bolts 36, 36A, so that the first- and second-side liner components 31, 31A are fixed on the front- and rear-side liner components 34. Thus, shots can definitely be prevented from being projected through the connecting part between the first- and second-side liner components 31, 31A and the front- and rear-side liner components 34, 34A. Also, it can be assured that the impeller cover is prevented from being abraded.

This invention allows liner components to be pressed against and fixed on an impeller cover. Thus, exchanging liner components for new ones is easy. Also, the connecting portions are closely fitted. Thus, shots can be prevented from being projected through the connecting portions. Also, the impeller cover can be prevented from being abraded.

What is claimed is:

1. A centrifugal projecting apparatus for projecting members, said apparatus comprising an impeller having radially located impeller blades and spaced first and second side impeller plates to which the blades are fixed, an impeller cover that surrounds front, rear, left, right, and ceiling sides of the impeller, said impeller cover having first and second side cover components having openings at left and right sides of said impeller, plate-like front and rear side cover components at front and rear sides of said impeller, and a moveable ceiling side cover component at an upper side of said impeller, said impeller cover being generally shaped like a box formed as a trapezoid, first and second side liner components located inside of and to protect the left and right sides of the impeller cover, front and rear side liner components located inside of and to protect the front and rear sides of the impeller cover, a ceiling-side liner component located inside of and to protect the ceiling side of the impeller cover, and a frame liner component for holding the first and second side liner components, front and rear linear components and ceiling side liner component together, wherein said first and second side liner components are generally shaped like trapezoids and have openings at the center thereof through which the first and second side impeller plates can pass, said first and second side liner components being fixed to the impeller cover by screws, said front and rear side liner components are generally U-shaped and inclined and are pressed against and fixed on right and left ends of the first and second side liner components by bolts that pass through the front- and rear-side cover components of the impeller cover, a labyrinthine structure is formed at the connecting surfaces between the ceiling side liner component and the first- and second-side liner components, said labyrinthine structure having at least four bent points bent in the direction of the projection of the projecting members to prevent the members from passing through said connecting surfaces, said frame liner component is shaped as a loop having a vertical plate that defines an opening through which upper ends of the first and second and front and rear liner components pass and are engaged with, pressed against, and fixed on the impeller cover, and said ceiling side liner component has a looped-projection 38 formed along the periphery of a lower surface thereof, said looped-projection being inserted into U-shaped grooves defined in the upper ends of the first and second and front and rear liner components and into the vertical plate of the frame-liner component, said ceiling-side liner component being pressed and held in place by a fixing member located on the impeller cover so that it is fixed on the frame-liner component.

2. The apparatus of claim 1 wherein the angle between each of the front and rear side liner components and the ceiling side liner component is from about 50 degrees to 80 degrees.

3. The apparatus of claim 1 wherein the second side liner component is screwed to the impeller cover through a spacer that is shaped as a horseshoe so as to adjust the distance between them.

4. The apparatus of claim 1 wherein the ceiling side liner component is pressed down and fixed on the frame liner component by hook members that are located on upper ends of the right and left sides of the impeller cover.

5. The apparatus of claim 1, 2, or 3 wherein the bolts are positioned by brackets that are removable from the front and rear side cover components.

* * * * *